US009688093B2

(12) United States Patent
Kawano et al.

(10) Patent No.: US 9,688,093 B2
(45) Date of Patent: Jun. 27, 2017

(54) ENCLOSING-SEALING DEVICE AND IMAGE FORMATION SYSTEM HAVING THE SAME

(75) Inventors: Masakazu Kawano, Ibaraki-ken (JP); Akinori Maekawa, Ibaraki-ken (JP)

(73) Assignee: RISO KAGAKU CORPORATION, Tokyo (JP)

( * ) Notice: Subject to any disclaimer, the term of this patent is extended or adjusted under 35 U.S.C. 154(b) by 953 days.

(21) Appl. No.: 13/334,805

(22) Filed: Dec. 22, 2011

(65) Prior Publication Data

US 2012/0159899 A1 Jun. 28, 2012

(30) Foreign Application Priority Data

Dec. 28, 2010 (JP) ..... P2010-293083

(51) Int. Cl.
*B43M 5/04* (2006.01)

(52) U.S. Cl.
CPC ..... *B43M 5/047* (2013.01); *B43M 5/04* (2013.01)

(58) Field of Classification Search
CPC B65B 25/14; B65B 57/04; B65B 5/04; B65B 11/48; B65B 11/004; B65B 49/00; B65H 2301/4318; B43M 3/045; B43M 3/04; B43M 5/04; B43M 5/042; B43M 5/045; B43M 5/047
USPC ..... 53/55, 284.3, 381.5, 460, 561, 235, 569, 53/206
See application file for complete search history.

(56) References Cited

U.S. PATENT DOCUMENTS 2,019,212 A * 10/1935 Clare ..... B43M 5/04 53/117
3,265,382 A * 8/1966 Sherman ..... B43M 5/04 270/45
3,416,785 A * 12/1968 Sherman ..... 270/45
3,593,486 A * 7/1971 Helm ..... B43M 5/04 53/206
4,003,183 A * 1/1977 Helm ..... B43M 5/04 493/210

(Continued)

FOREIGN PATENT DOCUMENTS

JP 02-225098 9/1990
JP 09-142091 6/1997

(Continued)

*Primary Examiner* — Stephen F Gerrity
(74) *Attorney, Agent, or Firm* — Greenblum & Bernstein, P.L.C.

(57) ABSTRACT

An enclosing-sealing device for preparing a sealed matter by sealing an envelope with a content enclosed in the envelope includes a content formation unit, an envelope formation unit, a content delivery unit, a seal unit, a delivery timing determiner, and a delivery controller. The content delivery unit delivers the content delivered from the content formation unit to the envelope formation unit such that the content is enclosed in a sheet of envelope paper while being folded. The seal unit seals the envelope delivered from the envelope formation unit with the content enclosed in the envelope. The delivery timing determiner determines a delivery timing of the content by the content delivery unit based on inputted information about at least one of the content and the envelope. The delivery controller controls the content delivery unit to deliver the content to the envelope formation unit in accordance with the determined delivery timing.

12 Claims, 9 Drawing Sheets

(56) References Cited

U.S. PATENT DOCUMENTS 4,071,997 A * 2/1978 Gunther, Jr. ..... B31B 41/00 493/199
4,312,169 A * 1/1982 Golicz et al. ..... 53/206
4,343,129 A * 8/1982 Gunther, Jr. ..... B31B 41/00 53/206
4,668,212 A * 5/1987 Kotani ..... 493/216
4,733,856 A * 3/1988 Gunther, Jr. ..... B07C 1/00 270/1.02
4,739,606 A * 4/1988 Cantile ..... 53/493
4,787,192 A * 11/1988 Gunther, Jr. ..... B43M 3/04 271/110
4,972,655 A * 11/1990 Ogawa ..... B31B 41/00 156/277
5,029,429 A * 7/1991 Noma et al. ..... B43M 3/04 53/120
5,067,305 A * 11/1991 Baker et al. ..... B07C 1/00 347/2
5,118,375 A * 6/1992 Malachowski et al. . B43M 3/04 156/216
5,127,640 A * 7/1992 Orsinger et al. ..... B43M 3/045 270/52.04
5,155,973 A * 10/1992 Hipko et al. ..... B43M 5/04 53/450
5,297,376 A * 3/1994 Taguchi et al. ..... 53/504
5,511,357 A * 4/1996 Ricketts et al. ..... 53/55
5,524,421 A * 6/1996 Nauheimer et al. ..... 53/460
5,640,835 A * 6/1997 Muscoplat ..... B43M 5/04 101/248
5,794,409 A * 8/1998 Akridge et al. ..... B65D 27/00 493/216
5,823,521 A * 10/1998 Emigh et al. ..... 270/58.06
5,941,516 A * 8/1999 Emigh et al. ..... B43M 3/045 270/58.06
5,954,323 A * 9/1999 Emigh et al. ..... B43M 3/045 270/58.06
6,016,638 A * 1/2000 Bernard et al. ..... 53/117
6,412,255 B2 * 7/2002 Hidding et al. ..... 53/460
6,718,740 B2 * 4/2004 Rivenbark et al. ..... 53/569
7,047,711 B2 * 5/2006 Ballestrazzi et al. ..... 53/569
7,565,788 B2 * 7/2009 Stemmle et al. ..... 53/429
7,765,017 B2 * 7/2010 Fijnvandraat ..... 700/19
7,770,368 B2 * 8/2010 Sugimoto et al. ..... 53/569
2002/0087491 A1 * 7/2002 Edens et al. ..... B43M 5/042 705/401
2003/0110739 A1 * 6/2003 Saas ..... 53/460
2006/0186592 A1 * 8/2006 Stemmle et al. ..... B43M 5/04 270/58.07
2006/0284360 A1 * 12/2006 Hume et al. ..... B43M 3/04 270/1.02
2008/0172145 A1 * 7/2008 Freyburger et al. ..... B43M 5/04 700/233
2009/0158693 A1 * 6/2009 Rosenkranz ..... B43M 3/04 53/468
2010/0066011 A1 * 3/2010 Orfei ..... 271/265.01
2010/0251673 A1 * 10/2010 Herapath et al. ..... B43M 3/04 53/467
2012/0076352 A1 * 3/2012 Quinn et al. ..... B43M 3/04 382/101

FOREIGN PATENT DOCUMENTS

JP 2002-370718 A 12/2002
JP 2010-195422 9/2010

* cited by examiner

FIG. 4A

| THICKNESS OF CONTENT PAPER | CORRECTION VALUE OF DELIVERY TIMING |
|---|---|
| THIN | $\alpha_1$ |
| RATHER THICK | $\alpha_2$ |
| THICK | $\alpha_3$ |
| VERY THICK | $\alpha_4$ |

FIG. 4B

| NUMBER OF PIECES OF CONTENT PAPER | CORRECTION VALUE OF DELIVERY TIMING |
|---|---|
| 1 | $\beta_1$ |
| 2 | $\beta_2$ |
| 3 | $\beta_3$ |
| 4 | $\beta_3$ |
| 5 | $\beta_5$ |

FIG. 4C

| SIZE OF CONTENT PAPER | CORRECTION VALUE OF DELIVERY TIMING |
|---|---|
| A4 | $\gamma_1$ |
| A3 | $\gamma_2$ |
| B4 | $\gamma_3$ |
| B5 | $\gamma_3$ |
| B6 | $\gamma_5$ |

FIG. 5A

| THICKNESS OF ENVELOPE PAPER | CORRECTION VALUE OF DELIVERY TIMING |
|---|---|
| THIN | $\lambda_1$ |
| RATHER THICK | $\lambda_2$ |
| THICK | $\lambda_3$ |
| VERY THICK | $\lambda_4$ |

FIG. 5B

| PERFORATION OF ENVELOPE PAPER | CORRECTION VALUE OF DELIVERY TIMING |
|---|---|
| FOUND | $\nu_1$ |
| NOT FOUND | $\nu_2$ |

ENCLOSING-SEALING DEVICE AND IMAGE FORMATION SYSTEM HAVING THE SAME

CROSS REFERENCE TO RELATED APPLICATION

This application is based upon and claims the benefit of priority from the prior Japanese Patent Application No. 2010-293083, filed on Dec. 28, 2010, the entire contents of which are incorporated herein by reference.

BACKGROUND OF THE INVENTION

1. Field of the Invention

The present invention relates to an enclosing-sealing device for preparing a sealed matter by forming a content and an envelope respectively from at least one printed sheet of content paper and a printed sheet of envelope paper and then sealing the envelope in a state that the content is enclosed in the envelope. The present invention also relates to an image formation system having the enclosing-sealing device.

2. Description of the Related Art

Recently, with an expansion of using sealed matters such as direct mail, various developments are made about an enclosing-sealing device. Structure and the like of a related and general enclosing-sealing device is briefly explained as below.

The general enclosing-sealing device has a device chassis. In the device chassis, a content formation unit for forming a content by folding sheets of content paper is disposed. In a position away from the content formation unit in the device chassis, there is provided an envelope formation unit for forming an envelope by folding a sheet of envelope paper. On an inlet side of the envelope formation unit in the device chassis, there is provided a content delivery unit. At a certain delivery timing which was so set in advance that the content delivered from the content formation unit can be enclosed in the sheet of envelope paper which is being folded, the content delivery unit delivers the content to the envelope formation unit. On an outlet side of the envelope formation unit in the device chassis, there is provided a seal unit. In a state that the content is enclosed in the envelope, the seal unit seals the envelope delivered from the envelope formation unit.

Thus, the content formation unit forms the content by folding the sheets of content paper and then delivers the content to the content delivery unit side. Then, the envelope formation unit forms the envelope by folding the sheet of envelope paper and then delivers the envelope to the seal unit side. Herein, when the envelope formation unit is folding the sheet of envelope paper, allowing the content delivery unit to deliver the content to the envelope formation unit side at a certain delivery timing set in advance can send the envelope to the seal unit side in a state that the content is enclosed in the envelope. Then, the seal unit seals the envelope, to thereby end preparation of the sealed matter.

Japanese Unexamined Patent Application Publication No. 2002-370718 is raised as a related art.

SUMMARY OF THE INVENTION

As stated above, the delivery timing by the content delivery unit is set constant. Meanwhile, there are various states about the content such as thickness, the number of sheets, the number of folds, size and the like of the content paper and various states about the envelope such as thickness, the presence or absence of perforation and the like of the envelope paper. Thus, as the case may be, the delivery timing of the content delivery unit is not proper depending on the states about the content or envelope. Therefore, when the delivery timing by the content delivery unit is too late, an enclosed state of the content will be incomplete, causing a enclosing failure of the envelope. On the other hand, when the delivery timing by the content delivery unit is too early, the envelope will be broken, thus degrading folding quality of the sealed matter.

It is an object of the present invention to provide an enclosing-sealing device having such a new structure as to sufficiently prevent an enclosing failure of an envelope and suppress degradation of folding quality of the sealed matter, and provide an image formation system having the same.

A first aspect of the invention is an enclosing-sealing device for preparing a sealed matter by sealing an envelope with a content enclosed in the envelope, the enclosing-sealing device comprising: a content formation unit configured to form the content by folding a sheet of content paper; an envelope formation unit configured to form the envelope by folding a sheet of envelope paper; a content delivery unit configured to deliver the content delivered from the content formation unit to the envelope formation unit such that the content is enclosed in the sheet of envelope paper while being folded; a seal unit configured to seal the envelope delivered from the envelope formation unit with the content enclosed in the envelope; a delivery timing determiner configured to determine a delivery timing of the content by the content delivery unit based on inputted information with respect to at least one of the content and the envelope; and a delivery controller configured to control the content delivery unit to deliver the content to the envelope formation unit in accordance with the delivery timing determined by the delivery timing determiner.

According to the first aspect, the delivery timing determiner determines the delivery timing based on the information with respect to the content and envelope, thereby the delivery timing of the content by the content delivery unit can be set to a proper delivery timing which is obtained in view of the states about the content and envelope, thereby making it possible to stabilize an enclosed state of the content, sufficiently prevent an enclosing failure of the envelope, prevent break and the like of the envelope and suppress degradation of folding quality of the sealed matter.

The enclosing-sealing device may further comprise: a table memory configured to store at least one of a content correction table defining a relation between the information with respect to the content and a correction value of the delivery timing, and an envelope correction table defining a relation between the information with respect to the envelope and the correction value of the delivery timing; a correction value calculator configured to calculate the correction value of the delivery timing based on the inputted information with respect to the at least one of the content and the envelope by referring respectively to the content correction table and the envelope correction table stored in the table memory, wherein the delivery timing determiner determines the delivery timing based on the correction value of the delivery timing calculated by the correction value calculator.

With the above structure, the correction value calculator calculates the correction value of the delivery timing based on the information with respect to the content and envelope by referring to the content correction table or envelope correction table, and the delivery timing determiner determines the delivery timing based on the correction value of the delivery timing, thus making it easy to set the delivery timing of the content.

The envelope formation unit may include a sensor configured to detect a timing to start folding the sheet of envelope paper, and the delivery controller may control the content delivery unit to deliver the content to the envelope formation unit after an elapse of time corresponding to the delivery timing determined by the delivery timing determiner from a time point of receiving an input of a detection signal from the sensor.

With the above structure, with the input of the detection signal from the sensor as a trigger, the delivery controller controls the content delivery unit such that the content is delivered to the envelope formation unit side in accordance with the delivery timing, thereby stabilizing the delivery of the content by the content delivery unit.

A second aspect of the invention is an image formation system comprising: an image formation device configured to perform printing on a sheet of content paper and a sheet of envelope paper; an enclosing-sealing device for preparing a sealed matter by sealing an envelope with a content enclosed in the envelope, the enclosing-sealing device being provided adjacent to the image formation device, the enclosing-sealing device including: a content formation unit configured to form the content by folding a sheet of content paper as printed; an envelope formation unit configured to form the envelope by folding a sheet of envelope paper as printed; a content delivery unit configured to deliver the content delivered from the content formation unit to the envelope formation unit such that the content is enclosed in the sheet of envelope paper while being folded; a seal unit configured to seal the envelope delivered from the envelope formation unit with the content enclosed in the envelope; a delivery timing determiner configured to determine a delivery timing of the content by the content delivery unit based on inputted information with respect to at least one of the content and the envelope; and a delivery controller configured to control the content delivery unit to deliver the content to the envelope formation unit in accordance with the delivery timing determined by the delivery timing determiner.

According to the second aspect, the image formation system has the image formation device and the enclosing-sealing device, thereby implementing printing on the sheet of content paper and the sheet of envelope paper, forming the content and envelope respectively from the sheet of content paper as printed and the sheet of envelope paper as printed. When the sealed matter is prepared, the image formation system can therefore sufficiently prevent an enclosing failure of the envelope and suppress degradation of folding quality of the sealed matter.

In the specification and claims of the present invention, the term "provided" includes that a member is directly provided and that the member is indirectly provided via another member.

BRIEF DESCRIPTION OF THE DRAWINGS

FIG. 4A is a diagram for explaining about a first content correction table, FIG. 4B is a diagram for explaining about a second content correction table, and FIG. 4C is a diagram for explaining about a third content correction table.

FIG. 5A is a diagram for explaining about a first envelope correction table and FIG. 5B is a diagram for explaining about a second envelope correction table.

DETAILED DESCRIPTION OF THE EMBODIMENT

An embodiment of the present invention is to be set forth referring to FIG. 1 to FIG. 9. In the following description, the term "upstream" is defined as upstream side in view of a direction of transferring sheets of content paper P1 and the like and the term "downstream" is defined as downstream side in view of the direction of transferring sheets of content paper P1 and the like. In FIG. 1 to FIG. 9, "L" denotes a left direction and "R" denotes a right direction.

Figure 2:
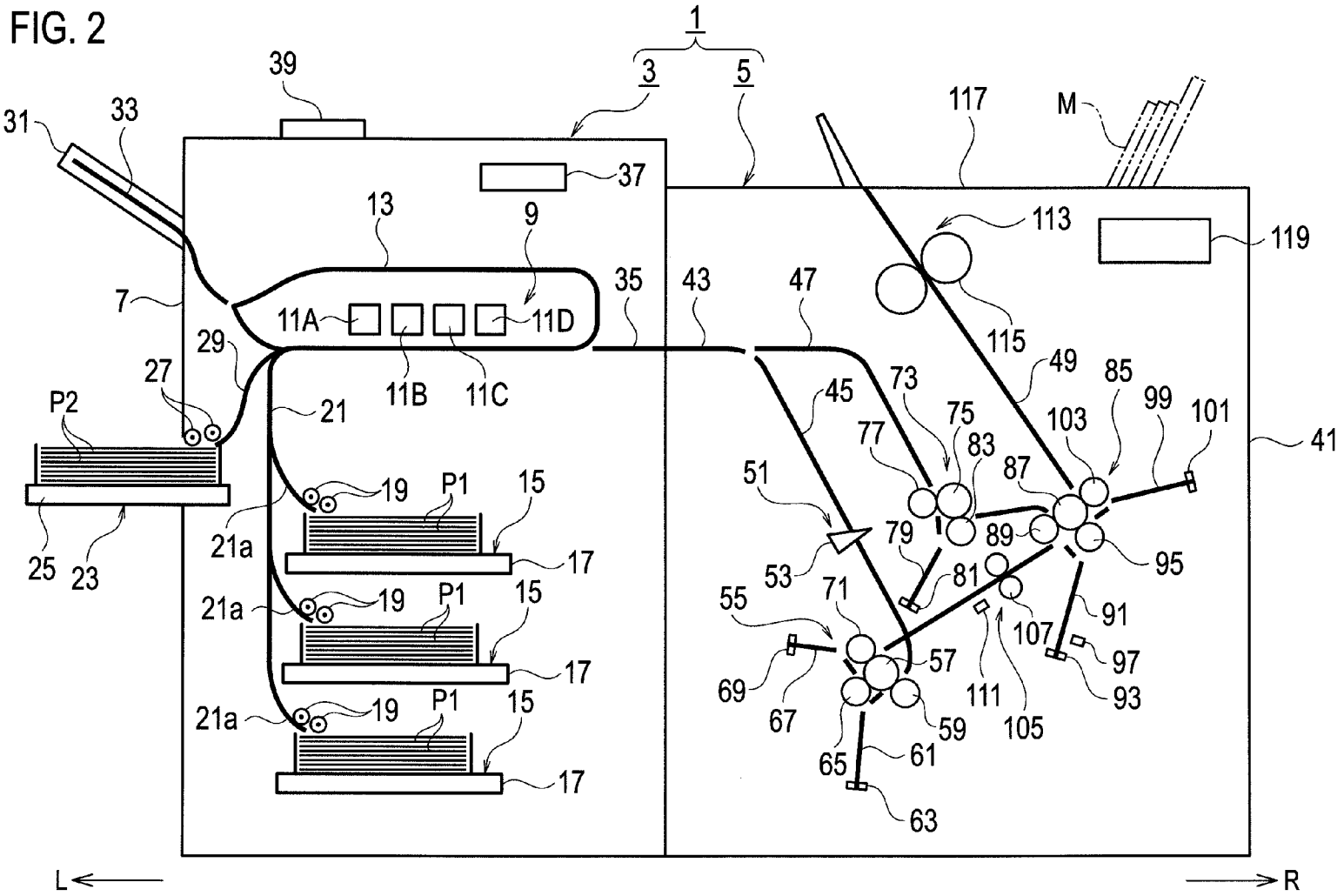
FIG. 2 is a schematic for explaining about an image formation system, according to the embodiment of the present invention.

As shown in FIG. 2, an image formation system 1 according to the embodiment of the present invention performs printing on sheets (or at least one sheet) of content paper P1 and a sheet of envelope paper P2, then, form a content B and an envelope E respectively from the sheets (or at least one sheet) of content paper P1 and the sheet of envelope paper P2 thus printed, and then, seals the envelope E in a state that the content B is enclosed in the envelope E, to thereby prepare a sealed matter M. In other words, the image formation system 1 is a combination of i) an image formation device 3 for performing printing on sheets of content paper P1 and a sheet of envelope paper P2 and ii) an enclosing-sealing device (sealed matter preparing unit) 5 provided in a position adjacent to the image formation device 3. From the printed sheets of content paper P1 and the printed sheet of envelope paper P2, the enclosing-sealing device 5 forms the content B and the envelope E respectively. Then, the envelope E is sealed in a state that the content B is enclosed in the envelope E, to thereby prepare the sealed matter M.

The image formation device 3 of the image formation system 1 is provided with an image formation device chassis 7 (hereinafter, properly referred to as "device chassis 7"). In the device chassis 7, there is provided an ink jet type print unit 9 which performs printing on sheets of content paper P1 and sheets of envelope paper P2 based on image data (content image data and envelope image data). The print unit 9 is provided with line-type ink jet heads 11A, 11B, 11C and 11D for discharging ink of colors such as black, cyan, magenta and yellow. A loop print transfer path 13 for transferring sheets of content paper P1 and sheets of envelope paper P2 is provided in the device chassis 7 in such a configuration as to surround the print unit 9. In a position along the print transfer path 13 in the device chassis 7, pairs of first transfer rollers (not shown) for sandwiching and transferring each sheet of the content paper P1 and each sheet of envelope paper P2 are disposed at certain intervals. The pairs of first transfer rollers are rendered rotatable by driving of a proper first transfer motor (not shown).

Below the print unit 9 in the device chassis 7, content paper feed units 15 for sequentially feeding sheets of content paper P1 to the print unit 9 side (print transfer path 13 side) are disposed in a stepwise manner in an upward-downward direction. Each of the sheets of content paper feed units 15 is provided with i) a paper feed tray 17 loaded with sheets of content paper P1 and ii) paper feed rollers 19 for sequentially delivering to the print unit 9 side sheets of content paper P1 stacked (loaded) on the paper feed tray 17. The paper feed rollers 19 are rendered rotatable by driving of a proper content paper feed motor (not shown). In the left portion in the device chassis 7, there is provided a paper feed transfer path 21 for transferring sheets of content paper P1 to the print unit 9 side. A downstream end side (base end side) of the paper feed transfer path 21 has three branching portions 21*a*. An end portion of each of the branching portions 21*a* of the paper feed transfer path 21 is connected to the content paper feed unit 15 which corresponds to the end portion of the branching portion 21*a*. An upstream end portion (tip end portion) of the paper feed transfer path 21 is connected to the print transfer path 13. In a position along the paper feed transfer path 21 in the device chassis 7, pairs of second transfer rollers (not shown) for sandwiching and transferring each sheet of content paper P1 are disposed at certain intervals. The pairs of second transfer rollers are rendered rotatable by driving of a proper second transfer motor (not shown).

On the left side portion of the device chassis 7, there is provided an envelope paper feed unit 23 for feeding sheets of envelope paper P2 to the print unit 9 side (print transfer path 13 side). The envelope paper feed unit 23 is provided with i) an auxiliary paper feed tray 25 to be loaded with sheets of envelope paper P2 and ii) auxiliary tray paper feed rollers 27 for delivering to the print unit 9 side sheets of envelope paper P2 stacked (loaded) on the auxiliary paper feed tray 25. The auxiliary tray paper feed rollers 27 are rendered rotatable by driving of a proper envelope paper feed motor (not shown). In the left portion in the device chassis 7, there is provided an auxiliary paper feed transfer path 29 for transferring sheets of envelope paper P2 to the print unit 9 side. An upstream end portion (base end portion) of the auxiliary paper feed transfer path 29 is connected to the envelope paper feed unit 23 and a downstream end portion (tip end portion) of the auxiliary paper feed transfer path 29 is connected to the print transfer path 13. In a position along the auxiliary paper feed transfer path 29 in the device chassis 7, pairs of third transfer rollers (not shown) for sandwiching and transferring each sheet of envelope paper P2 are disposed at certain intervals. The pairs of third transfer rollers are rendered rotatable by driving of a proper third transfer motor (not shown).

In the left upper portion of the print transfer path 13, there is provided a cassette 31 for temporarily receiving sheets of content paper P1 and sheets of envelope paper P2. From the left portion in the device chassis 7 to an area in the cassette 31, there is provided a switch back transfer path 33 for inverting each sheet of content paper P1 and each sheet of envelope paper P2 and then transferring each sheet of content paper P1 and each sheet of envelope paper P2 to the print unit 9 side. A base end portion of the switch back transfer path 33 can be connected to the print transfer path 13 and can be cut off from the print transfer path 13 by operation of a known switch back flapper (not shown). In the left portion in the device chassis 7, there is provided a pair of in-and-out rollers (not shown) which pull sheets of content paper P1 and sheets of envelope paper P2 to the switch back transfer path 33 side by sandwiching each sheet of content paper P1 and each sheet of envelope paper P2 and which deliver sheets of content paper P1 and sheets of envelope paper P2 from the switch back transfer path 33 side by sandwiching sheets of content paper P1 and sheets of envelope paper P2. The pair of in-and-out rollers are rendered rotatable by driving of a proper in-and-out transfer motor (not shown).

In the right portion in the device chassis 7, there is provided a communication transfer path 35 for transferring to the enclosing-sealing device 5 side (rightward) sheets of content paper P1 and sheets of envelope paper P2 which are delivered from the print transfer path 13. An upstream end portion (base end portion) of the communication transfer path 35 can be connected to the print transfer path 13 and can be cut off from the print transfer path 13 by operation of a known communication flapper (not shown). In a position along the communication transfer path 35 in the device chassis 7, pairs of fourth transfer rollers (not shown) for sandwiching and transferring each sheet of content paper P1 and each sheet of envelope paper P2 are disposed at certain intervals. The pairs of fourth transfer rollers are rendered rotatable by driving of a proper fourth transfer motor (not shown).

In a proper position in the device chassis 7, there is provided an image formation controller 37. The image formation controller 37 controls operations of the print unit 9, content paper feed unit 15, envelope paper feed unit 23 and the like. The image formation controller 37 has a memory for storing control programs and the like about the image formation and a CPU for implementing the control programs about the image formation. In the upper portion of the device chassis 7, there is provided an operation panel 39. The operation panel 39 can receive information as inputted information about the content B such as thickness, the number of sheets, size of the content paper P1 as well as information with respect to the envelope E such as thickness and the presence or absence of perforation of the envelope paper P2. The operation panel 39 is electrically connected to the image formation controller 37. In place of the operation panel 39 receiving the information about the content B and envelope E, the information with respect to the content B and envelope E may be inputted from an external personal computer (not shown).

Figure 1:
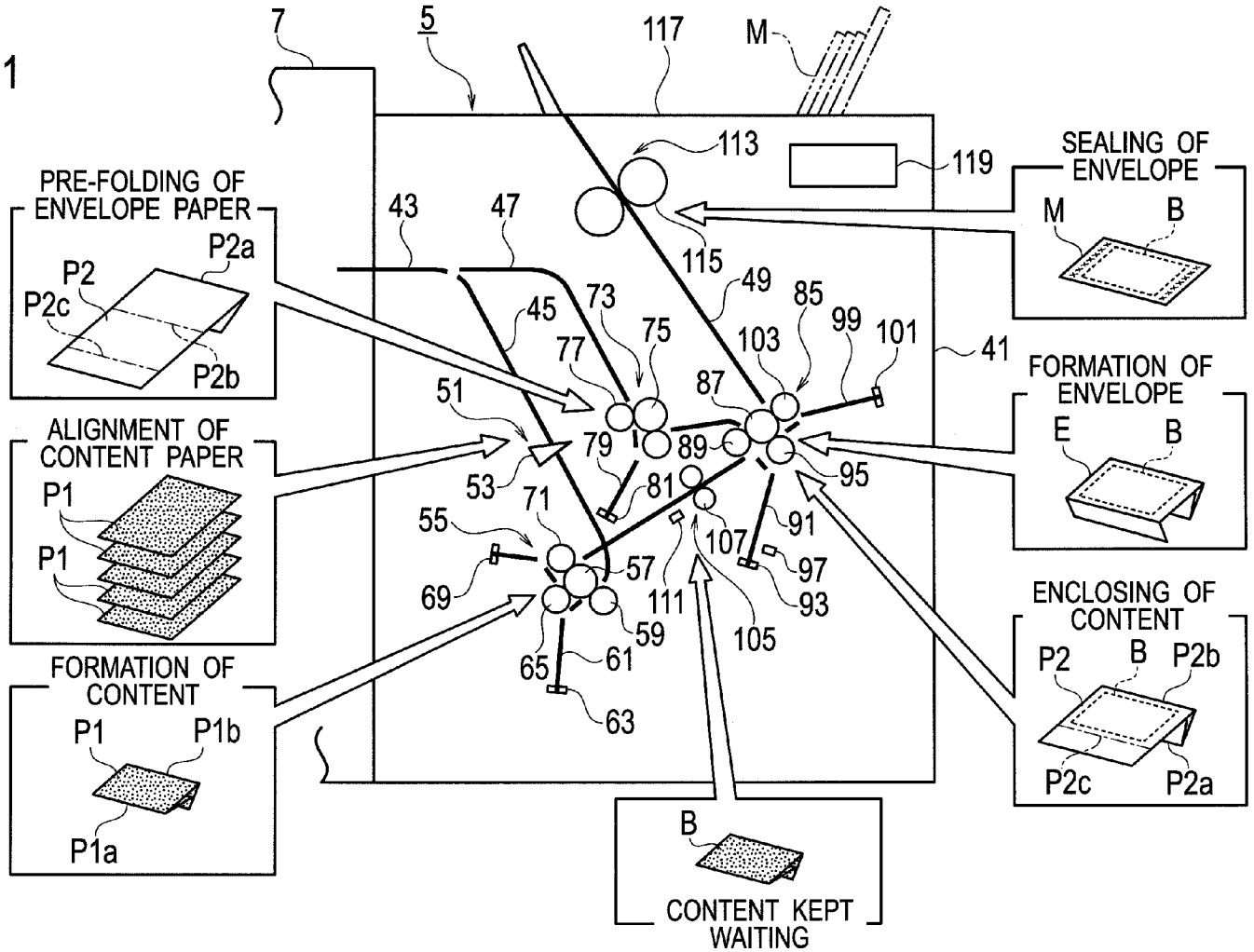
FIG. 1 is a schematic for explaining about an enclosing-sealing device and processes for forming sheets of content paper and the like, according to an embodiment of the present invention.

As shown in FIG. 1 and FIG. 2, the enclosing-sealing device 5 in the image formation system 1 is provided with an enclosing-sealing device sub-chassis 41 (hereinafter, properly referred to as "device sub-chassis 41"). In device sub-chassis 41, there is provided an introduction transfer path 43 for transferring in the rightward direction printed sheets of content paper P1 and printed sheets of envelope paper P2 which are delivered from the communication transfer path 35 (image formation device 3). An upstream end portion (based end portion) of the introduction transfer path 43 is connected to a downstream end portion (tip end portion) of the communication transfer path 35. In a position along the introduction transfer path 43, pairs of fifth transfer rollers (not shown) for sandwiching and transferring printed sheets of content paper P1 and printed sheets of envelope paper P2 are disposed at certain intervals. The pairs of fifth transfer rollers are rendered rotatable by driving of a proper fifth transfer motor (not shown).

In device sub-chassis 41, there is provided a content paper transfer path 45 for transferring printed sheets of content paper P1 (including a content B) and the like. An upstream end portion (base end portion) of the content paper transfer path 45 can be connected to a downstream end portion (tip end portion) of the introduction transfer path 43 and can be cut off from the downstream end portion of the introduction transfer path 43 by an operation of a known enclosing-sealing flapper. In a position along the content paper transfer path 45 in device sub-chassis 41, pairs of sixth transfer rollers (not shown) for sandwiching and transferring printed sheets of content paper P1 and the like are disposed at certain intervals. The pairs of sixth transfer rollers are rendered rotatable by driving of a proper sixth transfer motor (not shown).

On the upper side of the content paper transfer path 45 in device sub-chassis 41, there is provided an envelope paper transfer path 47 for transferring printed sheets of envelope paper P2. An upstream end portion (base end portion) of the envelope paper transfer path 47 can be connected to a downstream end portion of the introduction transfer path 43 and can be cut off from the downstream end portion of the introduction transfer path 43 by an operation of the above-mentioned enclosing-sealing flapper. In a position along the envelope paper transfer path 47 in device sub-chassis 41, pairs of seventh transfer rollers (not shown) for sandwiching and transferring each printed sheet of envelope paper P2 are disposed at certain intervals. The pairs of seventh transfer rollers are rendered rotatable by driving of a proper seventh transfer motor (not shown).

A downstream end side of the content paper transfer path 45 merges with a downstream end side of the envelope paper transfer path 47. On a downstream side (outlet side) of a merging portion between the content paper transfer path 45 and the envelope paper transfer path 47 in device sub-chassis 41, there is provided an envelope transfer path 49 for transferring the envelope E and the like (including a sealed matter M) in a state that the content B is enclosed in the envelope E. The envelope transfer path 49 extends to an upper portion of device sub-chassis 41. In a position along the envelope transfer path 49 in device sub-chassis 41, pairs of eighth transfer rollers (not shown) for sandwiching and transferring the envelope E and the like are disposed at certain intervals.

On the way of the content paper transfer path 45, there is provided an alignment unit 51. The alignment unit 51 collects and aligns printed sheets of content paper P1 delivered from the introduction transfer path 43. The alignment unit 51 is provided with an alignment gate (waiting gate) 53 for allowing the printed sheets of content paper P1 to wait. The alignment gate 53 can switch the content paper transfer path 45 between an opened state and a closed state.

On an outlet side (downstream side) of the alignment unit 51 in the content paper transfer path 45, there is provided a content formation unit 55. The content formation unit 55 folds the aligned sheets of content paper P1 (hereinafter, properly referred to as "sheets of content paper P1") which are delivered from the alignment unit 51, to thereby form the content B. Specific structure of the content formation unit 55 is set forth as below.

On an outlet side (downstream side) of the alignment unit 51 in device sub-chassis 41, main fold roller 57 is rotatably disposed. In a position adjacent to main fold roller 57 in device sub-chassis 41, introduction roller 59 is rotatably disposed. Introduction roller 59 introduces sheets of content paper P1 from the content paper transfer path 45 in cooperation with main fold roller 57. Below main fold roller 57 in device sub-chassis 41, there is provided guide plate 61 for guiding sheets of content paper P1 introduced by main fold roller 57 and introduction roller 59. Guide plate 61 has end member 63 which abuts on the sheets of content paper P1 (tip end thereof) and thereby gives a looseness to an area in the vicinity of fold line P1*a* of the sheets of content paper P1. Position of end member 63 can be adjusted along guide plate 61 by driving of a proper first position adjusting motor (not shown). In a position adjacent to main fold roller 57 and opposed to introduction roller 59 in device sub-chassis 41, intermediate roller 65 is rotatably disposed. With the area in the vicinity of fold line P1*a* of the sheets of content paper P1 loosened, intermediate roller 65 folds the sheets of content paper P1 along fold line P1*a* in cooperation with main fold roller 57.

On the left side of main fold roller 57 in device sub-chassis 41, there is provided guide plate 67 for guiding the sheets of content paper P1 folded by main fold roller 57 and intermediate roller 65. Guide plate 67 has end member 69 which abuts on the sheets of content paper P1 (tip end thereof) and thereby gives a looseness to an area in the vicinity of fold line P1*b* of the sheets of content paper P1. Position of end member 69 can be adjusted along guide plate 67 by driving of a proper second position adjusting motor (not shown). In a position adjacent to main fold roller 57 and opposed to intermediate roller 65 in device sub-chassis 41, lead-out roller 71 is rotatably disposed. With the area in the vicinity of fold line P1*b* of the sheets of content paper P1 loosened, lead-out roller 71 folds the sheets of content paper P1 along fold line P1*b* in cooperation with main fold roller 57 and meanwhile leads out the sheets of content paper P1 to the content paper transfer path 45 side.

Each of main fold roller 57, introduction roller 59, intermediate roller 65 and lead-out roller 71 is rendered rotatable by driving of a proper first fold motor (not shown).

On the way of the envelope paper transfer path 47, there is provided a pre-fold unit 73. Pre-fold unit 73 performs a preliminary folding (pre-folding) of a printed sheet of envelope paper P2 (hereinafter, properly referred to as "a sheet of envelope paper P2") delivered from the communication transfer path 35. Specific structure of pre-fold unit 73 is set forth as below.

On the way of the envelope paper transfer path 47 in device sub-chassis 41, a main fold roller 75 is rotatably disposed. In a position adjacent to main fold roller 75 in device sub-chassis 41, introduction roller 77 for introducing a sheet of envelope paper P2 from the envelope paper transfer path 47 in cooperation with main fold roller 75 is rotatably disposed. Below main fold roller 75 in device sub-chassis 41, there is provided guide plate 79 for guiding the sheet of envelope paper P2 introduced by main fold roller 75 and introduction roller 77. Guide plate 79 has end member 81 which abuts on the sheet of envelope paper P2 (tip end thereof) and thereby gives a looseness to an area in the vicinity of fold line P2*a* of the sheet of envelope paper P2. Position of end member 81 can be adjusted along guide plate 79 by driving of a proper third position adjusting motor (not shown). In a position adjacent to main fold roller 75 and opposed to introduction roller 77 in device sub-chassis 41, a lead-out roller 83 is rotatably disposed. With the area in the vicinity of fold line P2*a* of the sheet of envelope paper P2 loosened, lead-out roller 83 folds the sheet of envelope paper P2 along fold line P2*a* in cooperation with main fold roller 75 and meanwhile leads out the sheet of envelope paper P2 to the envelope paper transfer path 47 side.

Each of main fold roller 75, introduction roller 77 and lead-out roller 83 is rendered rotatable by driving of a proper second fold motor (not shown).

In the merging portion of the content paper transfer path 45 and envelope paper transfer path 47, there is provided an envelope formation unit 85. Envelope formation unit 85 folds a sheet of envelope paper P2 delivered from pre-fold unit 73 to thereby form the envelope E. Specific structure of envelope formation unit 85 is set forth as below.

On an outlet side (downstream side) of pre-fold unit 73 in device sub-chassis 41, a main fold roller 87 is rotatably disposed. In a position adjacent to main fold roller 87 in device sub-chassis 41, introduction roller 89 for introducing a sheet of envelope paper P2 from the envelope paper transfer path 47 in cooperation with main fold roller 87 is rotatably disposed. Below main fold roller 87 in device sub-chassis 41, there is provided guide plate 91 for guiding the sheet of envelope paper P2 introduced by main fold roller 87 and introduction roller 89. Guide plate 91 has end member 93 which abuts on the sheet of envelope paper P2 (tip end thereof) and thereby gives a looseness to an area in the vicinity of fold line P2*b* of the sheet of envelope paper P2. Position of end member 93 can be adjusted along guide plate 91 by driving of a proper fourth position adjusting motor (not shown). In a position adjacent to main fold roller 87 and opposed to introduction roller 89 in device sub-chassis 41, intermediate roller 95 is rotatably disposed. With the area in the vicinity of fold line P2*b* of the sheet of envelope paper P2 loosened, intermediate roller 95 folds the sheet of envelope paper P2 along fold line P2*b* in cooperation with main fold roller 87.

In the vicinity of guide plate 91 in device sub-chassis 41, there is provided an envelope paper sensor 97 such as reflection-type photoelectric sensor. The envelope paper sensor 97 detects that a sheet of envelope paper P2 is close to end member 93, in other words, detects a timing for envelope formation unit 85 (by cooperation of main fold roller 87 and intermediate roller 95) to start folding the sheet of envelope paper P2.

On the right side of main fold roller 87 in device sub-chassis 41, there is provided guide plate 99 for guiding a sheet of envelope paper P2 which is folded by main fold roller 87 and intermediate roller 95. Guide plate 99 has end member 101 which abuts on the sheet of envelope paper 2P (tip end thereof) and thereby gives a looseness to an area in the vicinity of fold line P2*c* of the sheet of envelope paper P2. Position of end member 101 can be adjusted along guide plate 99 by driving of a proper fifth position adjusting motor (not shown). In a position adjacent to main fold roller 87 and opposed to intermediate roller 95 in device sub-chassis 41, lead-out roller 103 is rotatably disposed. With the area in the vicinity of fold line P2*c* of the sheet of envelope paper P2 loosened, lead-out roller 103 folds the sheet of envelope paper P2 along fold line P2*c* in cooperation with main fold roller 87 and meanwhile leads out the sheet of envelope paper P2 to the envelope transfer path 49 side.

Each of main fold roller 87, introduction roller 89, intermediate roller 95 and lead-out roller 103 is rendered rotatable by driving of a proper third fold motor (not shown).

On an inlet side (upstream side) of envelope formation unit 85 on the way of the content paper transfer path 45, there is provided a content delivery unit 105. The content delivery unit 105 delivers the content B delivered from the content formation unit 55 to envelope formation unit 85 side such that the content B is enclosed in a sheet of envelope paper P2 which is in the process of being folded along fold line P2*b*. The content delivery unit 105 includes a pair of delivery rollers 107 for delivering the content B to envelope formation unit 85 side. The pair of delivery rollers 107 are rendered rotatable by driving of a proper delivery motor 109 (see FIGS. 6A and 6B). In the vicinity of the pair of delivery rollers 107 in device sub-chassis 41, there is provided a content sensor 111 such as reflective-type photoelectric sensor. The content sensor 111 detects that the content B (tip end thereof) approaches envelope formation unit 85.

On the way of the envelope transfer path 49, there is provided a seal unit 113. The seal unit 113 seals the envelope E delivered from envelope formation unit 85. The seal unit 113 is provided with a pair of seal rollers 115 for sandwiching and pressing the envelope E. The pair of seal rollers 115 are rendered rotatable by driving of a proper seal motor (not shown). The envelope E sandwiched and pressed by the pair of seal rollers 115 is sealed by an adhesion operation of a pressure-sensitive adhesive and a watery glue which were applied to a sheet of envelope paper P2 in advance. On an outlet side (downstream end side) of the envelope transfer path 49 in the upper portion of the device sub-chassis 41, there is provided a sealed matter discharge unit 117 for discharging the sealed matter M delivered from the envelope transfer path 49.

Then, details of the embodiment of the present invention are to be set forth.

Figure 3:
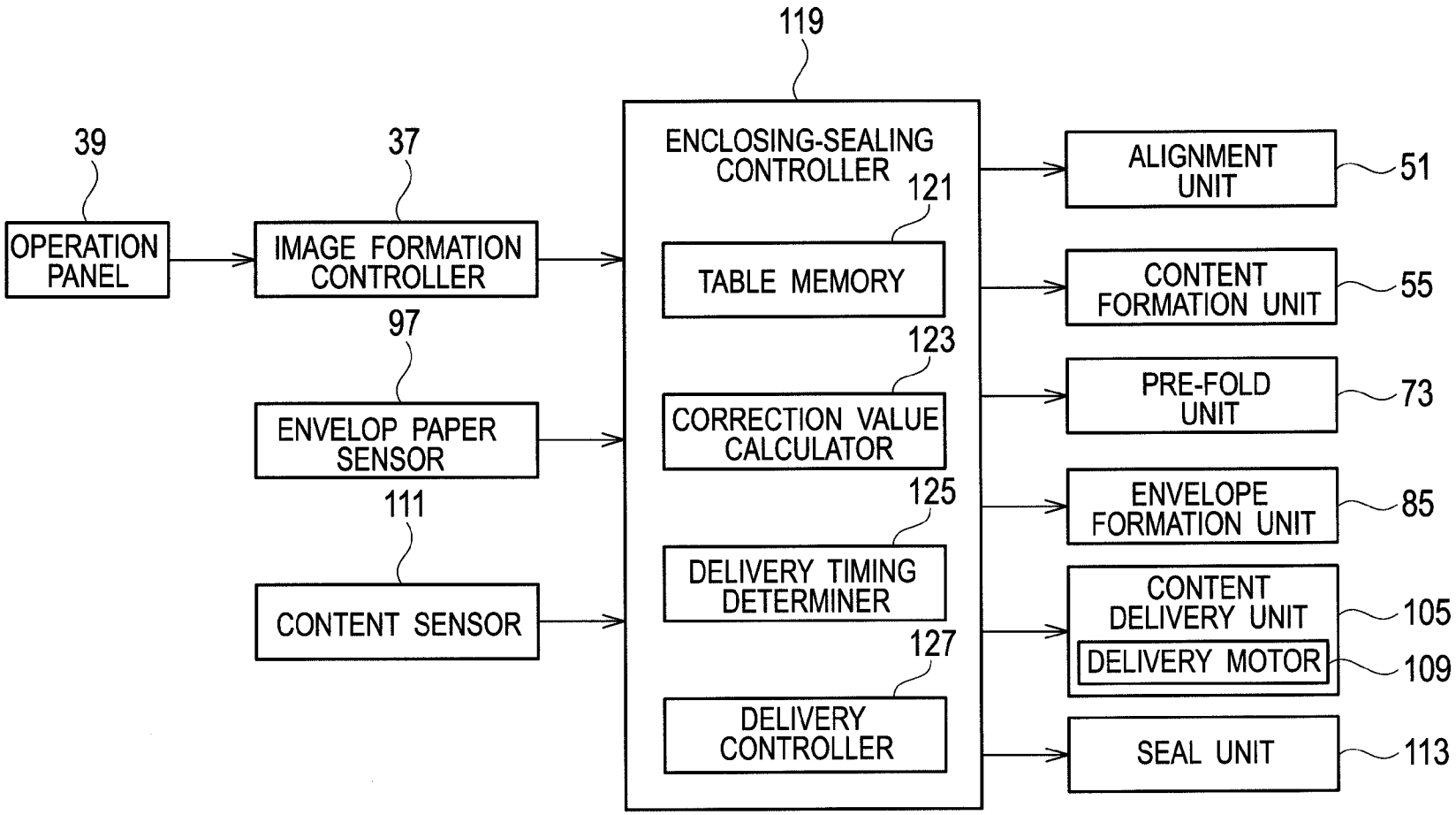
FIG. 3 is a control block diagram for explaining about an enclosing-sealing controller of the enclosing-sealing device, according to the embodiment of the present invention.

As shown in FIG. 3, an enclosing-sealing controller 119 is disposed in a proper position in the device sub-chassis 41. The enclosing-sealing controller 119 controls operations of the alignment unit 51, content formation unit 55, pre-fold unit 73, envelope formation unit 85, content delivery unit 105, seal unit 113 and the like. The enclosing-sealing controller 119 has a memory for storing control programs and the like on the enclosing-sealing and a CPU for implementing the control programs on the enclosing-sealing. The image formation controller 37, the envelope paper sensor 97 and the content sensor 111 are electrically connected with the enclosing-sealing controller 119. The memory of the enclosing-sealing controller 119 has a function as a table memory 121. The CPU of the enclosing-sealing controller 119 has a function as a correction value calculator 123, a function as a delivery timing determiner 125, and a function as a delivery controller 127. Details of the table memory 121, correction value calculator 123, delivery timing determiner 125 and delivery controller 127 are set forth below.

The table memory 121 stores a first content correction table defining a relation between a thickness of each sheet of content paper P1 as the information with respect to the content B and a correction value of the delivery timing (refer to FIG. 4A), a second content correction table defining a relation between the number of sheets of the content paper P1 as the information with respect to the content B and the correction value of the delivery timing (refer to FIG. 4B), a third content correction table defining a relation between a size of each sheet of content paper P1 as the information with respect to the content B and the correction value of the delivery timing (refer to FIG. 4C), a first envelope correction table defining a relation between a thickness of a sheet of envelope paper P2 as the information with respect to the envelope E and the correction value of the delivery timing (refer to FIG. 5A), and a second envelope correction table defining a relation between the presence or absence of perforation of a sheet of envelope paper P2 as the information with respect to the envelope E and the correction value of the delivery timing (refer to FIG. 5B). Other than the first content correction table, second content correction table, third content correction table, first envelope correction table and second envelope correction table, the table memory 121 may store i) another content correction table defining a relation between the information with respect to the content B other than the thickness and the like of the sheets of content paper P1 and the correction value of the delivery timing and ii) another envelope correction table defining a relation between the information with respect to the envelope E other than the thickness and the like of the sheet of envelope paper P2 and the correction value of the delivery timing.

Referring to the first content correction table, second content correction table, third content correction table, first envelope correction table and second envelope correction table which are stored in the table memory 121, the correction value calculator 123 calculates the correction value of the delivery timing of the content B by the content delivery unit 105, where the calculation is performed based on the thickness, the number of sheets, size of the content paper P1 which are inputted to the enclosing-sealing controller 119 and based on the thickness and the presence or absence of perforation of a sheet of envelope paper P2 which are inputted to the enclosing-sealing controller 119. A calculation method used for calculating the correction value of the delivery timing is provided in advance through experiments.

The delivery timing determiner 125 determines the delivery timing based on the correction value of the delivery timing which value was calculated by the correction value calculator 123. Determination of the delivery timing is performed, for example, by multiplying a standard delivery timing obtained in advance through experiments by the correction value of the delivery timing, or by adding the correction value of the delivery timing to the standard delivery timing obtained in advance through experiments.

With an input of a detection signal from the envelope paper sensor 97 as a trigger (reference), the delivery controller 127 controls the delivery motor 109 of the content delivery unit 105 such that the content B can be delivered to the envelope formation unit 85 side in accordance with the delivery timing determined by the delivery timing determiner 125. That is, the delivery controller 127 controls the delivery motor 109 of the content delivery unit 105 such that the content B can be delivered to the envelope formation unit 85 side after an elapse of time corresponding to the delivery timing determined by the delivery timing determiner 125 from a time point of receiving input of the detection signal from the envelope paper sensor 97. When a detection signal from the content sensor 111 is inputted to the enclosing-sealing controller 119, the delivery controller 127 so controls the delivery motor 109 of the content delivery unit 105 as to stop driving.

Operations of the image formation system 1 will be set forth including operations of the embodiment of the present invention.

Figure 8:
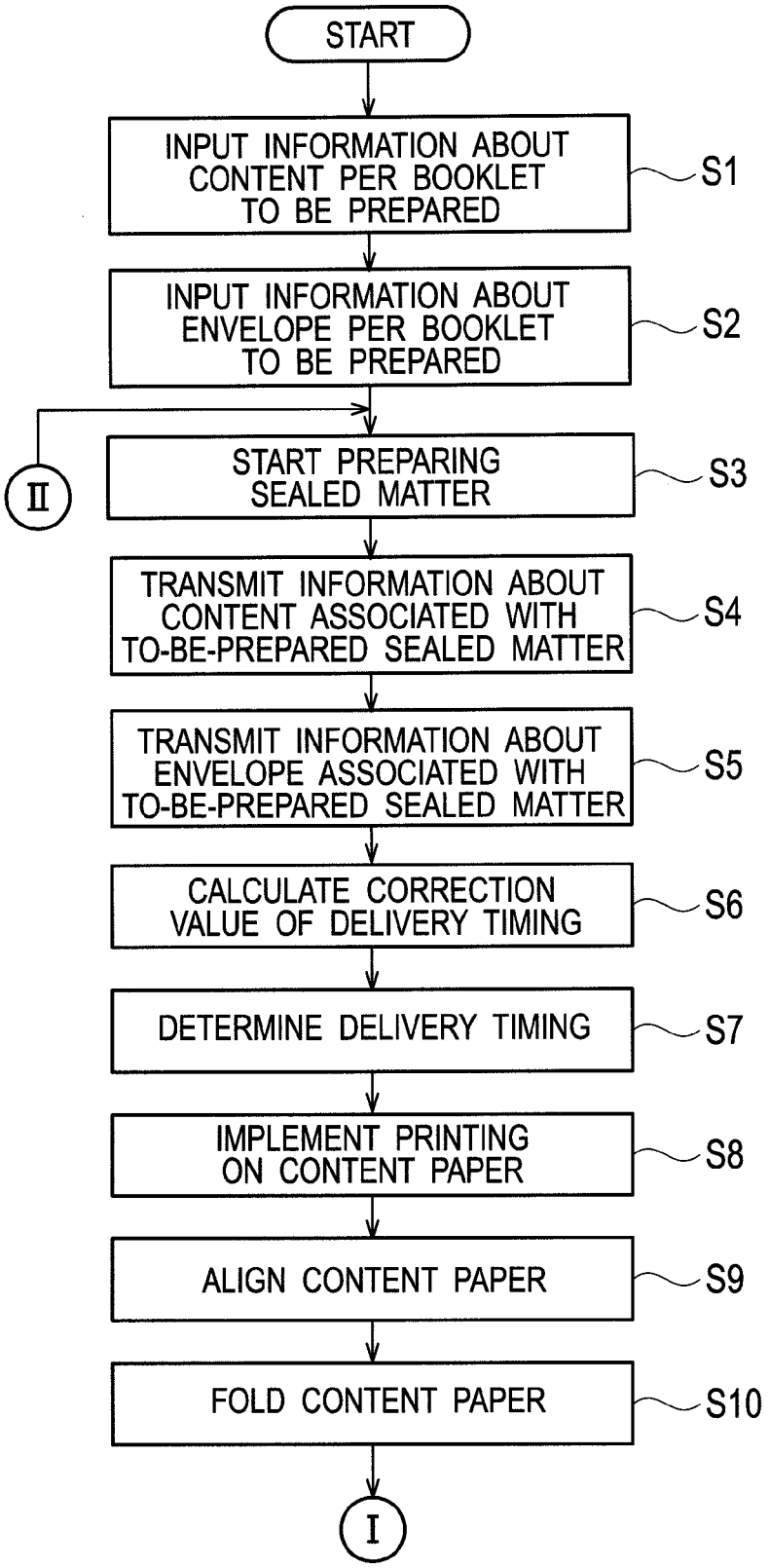
FIG. 8 is a flowchart for explaining about operations of the image formation system, according to the embodiment of the present invention.
Figure 9:
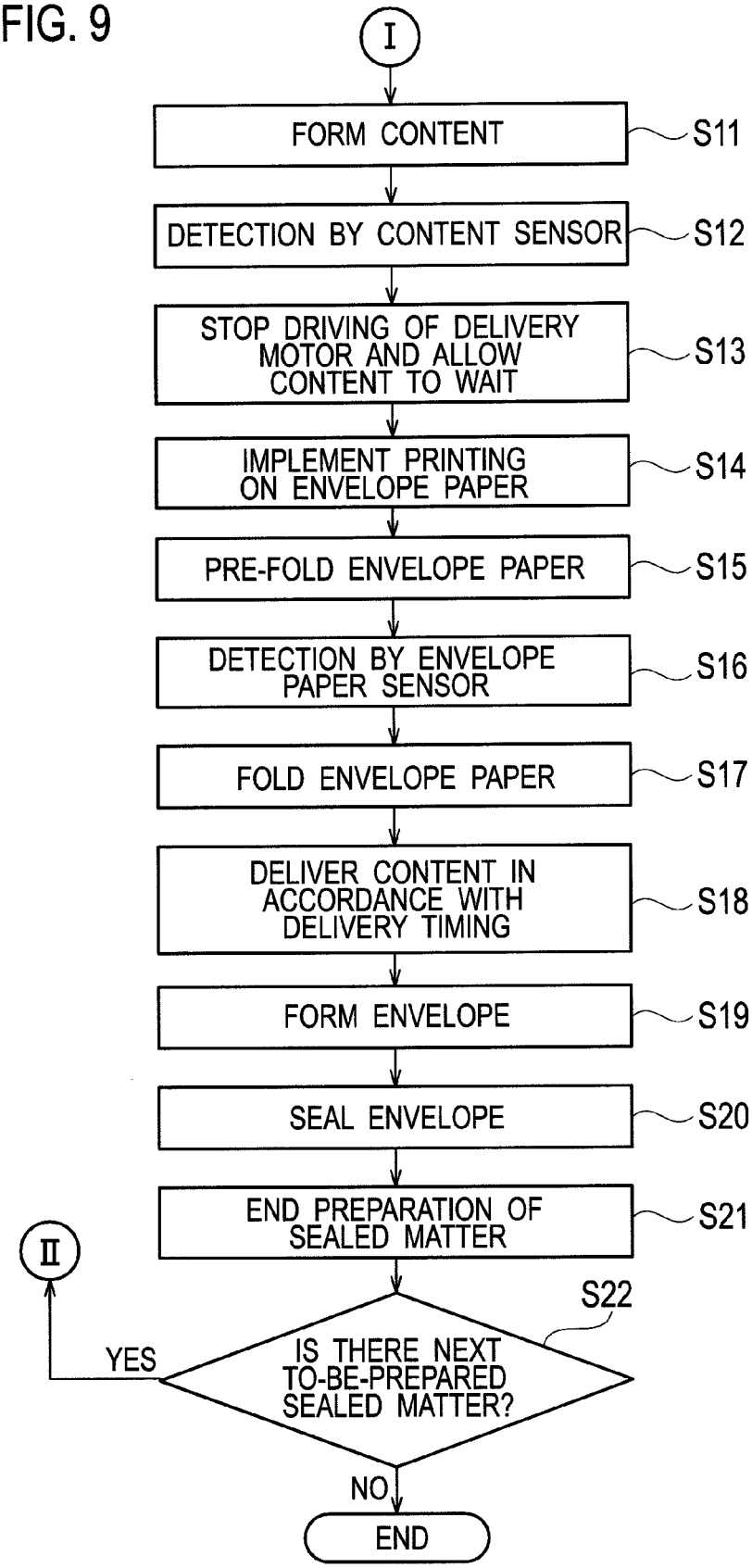
FIG. 9 is a flowchart for explaining about operations of the image formation system, according to the embodiment of the present invention.

To the image formation controller 37, input operation by the operation panel 39 inputs the thickness, the number of sheets and size of the content paper P1 as information with respect to the content B, and the thickness and the presence or absence of perforation of a sheet of envelope paper P2 as information with respect to the envelope E, where the above input operation is made per sealed matter M to be prepared (steps 1 and 2 in FIG. 8).

When the preparing of the sealed matter M is actually started after an end of step 2 (step 3 in FIG. 8), the information (information data) about the content B which is associated with the to-be-prepared sealed matter M and the information (information data) about the envelope E which is associated with the to-be-prepared sealed matter M are transmitted (inputted) from the image formation controller 37 to the enclosing-sealing controller 119 (steps 4 and 5 in FIG. 8). Referring to the first content correction table, second content correction table, third content correction table, first envelope correction table and second envelope correction table, the correction value calculator 123 (CPU of the enclosing-sealing controller 119) calculates the correction value of the delivery timing, where the calculation is performed based on the input information (information data) about the content B and based on the input information (information data) about the envelope E such as thickness of the sheet of envelope paper P2 (step 6 in FIG. 8). Moreover, the delivery timing determiner 125 (CPU of the enclosing-sealing controller 119) determines the delivery timing based on the correction value of the delivery timing (step 7 in FIG. 8). With this, the delivery timing of the content B by the content delivery unit 105 can be set to a proper timing which is obtained in view of the states about the content B and envelope E.

After an end of step 7, the content paper feed unit 15 sequentially feeds sheets of content paper P1 to the print unit 9 side (print transfer path 13 side) by way of the paper feed transfer path 21. Then, with the thus sequentially fed content paper P1 transferred along the print transfer path 13, the print unit 9 sequentially performs printing on the sheets of content paper P1 based on the content image data (step 8 in FIG. 8). Herein, transferring the content paper P1 in a circulating manner by way of the switch back transfer path 33 allows the print unit 9 to perform double-side printing on the sheets of content paper P1.

After an end of step 8, the printed sheets of content paper P1 are sequentially delivered to the introduction transfer path 43 side (enclosing-sealing device 5 side) by way of the communication transfer path 35. Then, the sheets of content paper P1 are transferred along the introduction transfer path 43 and content paper transfer path 45, to thereby sequentially deliver the sheets of content paper P1 to the alignment gate 53 side which is in the closed state. Then, the alignment unit 51 aligns the sheets of content paper P1 (step 9 in FIG. 8).

After an end of step 9, the alignment gate 53 is switched from the closed state to the open state, to thereby deliver the aligned sheets of content paper P1 to the content paper transfer path 45 side. Then, the sheets of content paper P1 is transferred to the content formation unit 55 side along the content paper transfer path 45. Then, in the content formation unit 55, the cooperation between the main fold roller 57 and introduction roller 59 introduces the sheets of content paper P1 from the content paper transfer path 45, to thereby fold the sheets of content paper P1 by the content formation unit 55 (step 10 in FIG. 8).

Specifically, with the area in the vicinity of fold line P1*a* of the sheets of content paper P1 loosened, the cooperation between the main fold roller 57 and the intermediate roller 65 folds the sheets of content paper P1 along fold line P1*a*. Then, with the area in the vicinity of fold line P1*b* of the sheets of content paper P1 loosened, the cooperation between the main fold roller 57 and lead-out roller 71 folds the sheets of content paper P1 along fold line P1*b* while leading out the sheets of content paper P1 to the content paper transfer path 45 side. With this, the content B is formed from the aligned sheets of content paper (printed sheets of content paper) P1, thereby making it possible to deliver the content B from the content formation unit 55 side (step 11 in FIG. 9).

Figure 6A:
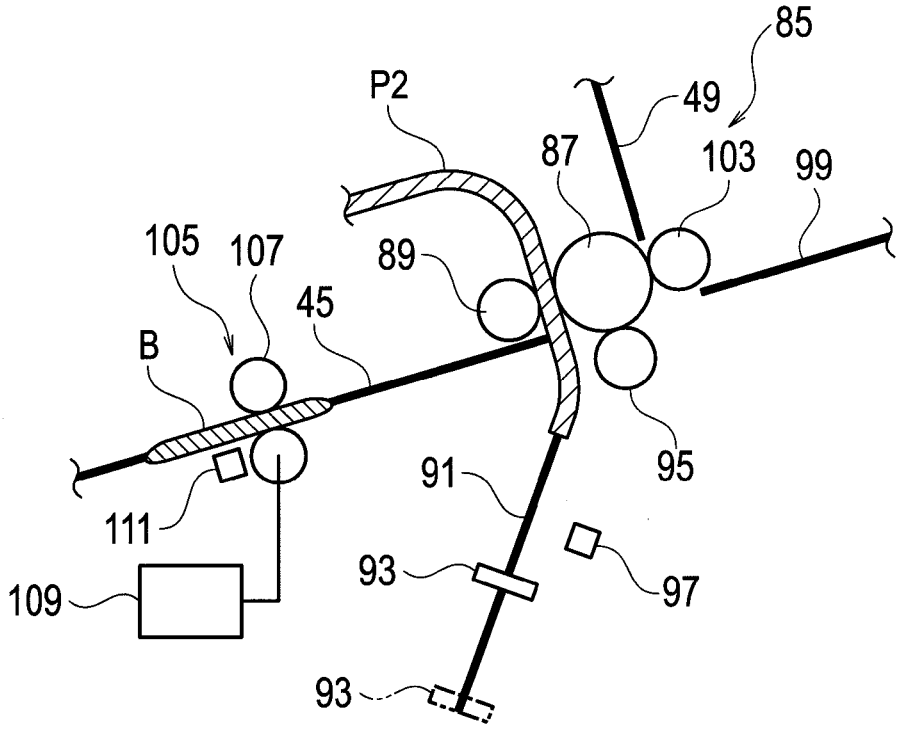
FIGS. 6A and 6B are diagrams for explaining about operations of an envelope formation unit and a content delivery unit of the enclosing-sealing device, according to the embodiment of the present invention, where a content and a sheet of envelope paper are denoted schematically.

After an end of step 11, the content B is transferred along the content paper transfer path 45 and then is allowed to proceed to an area between a pair of delivery rollers 107 which are rotating. Then, as shown in FIG. 6A, when the content sensor 111 detects that the content B approaches the envelope formation unit 85 (step 12 in FIG. 9), that is, when the detection signal from the content sensor 111 is inputted to the enclosing-sealing controller 119, the delivery controller 127 (CPU of the enclosing-sealing controller 119) stops driving of the delivery motor 109. With this, the content B is allowed to wait on the inlet side of the envelope formation unit 85 (step 13 in FIG. 9).

After an end of step 13, the envelope paper feed unit 23 feeds a sheet of envelope paper P2 to the print unit 9 side (print transfer path 13 side) by way of the auxiliary paper feed transfer path 29. Then, with the sheet of envelope paper P2 transferred along the print transfer path 13, the print unit 9 performs printing on the sheet of envelope paper P2 based on the envelope image data (step 14 in FIG. 9). Herein, transferring the sheet of envelope paper P2 in a circulating manner by way of the switch back transfer path 33 allows the print unit 9 to perform double-side printing on the sheet of envelope paper P2.

After an end of step 14, the printed sheet of envelope paper P2 is delivered to the introduction transfer path 43 side (enclosing-sealing device 5 side) by way of the communication transfer path 35. Then, the sheet of envelope paper P2 is transferred to the pre-fold unit 73 side along the introduction transfer path 43 and envelope paper transfer path 47. Then, the cooperation between main fold roller 75 and introduction roller 77 in pre-fold unit 73 introduces the sheet of envelope paper P2 from the envelope paper transfer path 47, to thereby allow pre-fold unit 73 to fold the sheet of envelope paper P2 in advance (step 15 in FIG. 9). Specifically, with the area in the vicinity of fold line P2*a* of the sheet of envelope paper P2 loosened, the cooperation between main fold roller 75 and lead-out roller 83 folds the sheet of envelope paper P2 along fold line P2*a* while leading out the sheet of envelope paper P2 to the envelope paper transfer path 47 side.

Figure 6B:
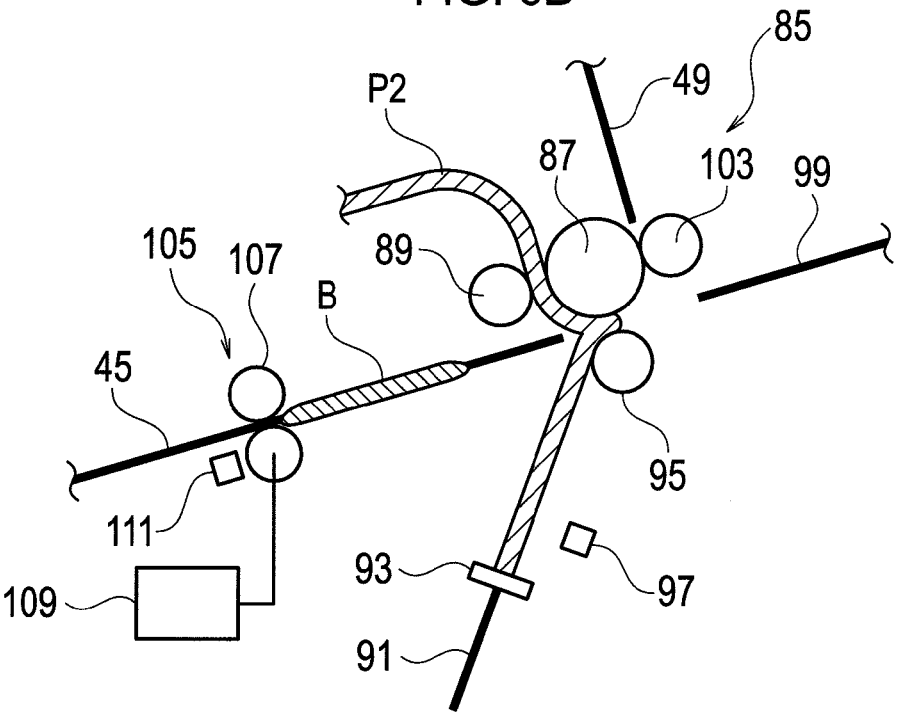

After an end of step 15, the envelope paper P2 is transferred to envelope formation unit 85 side along the envelope paper transfer path 47. Then, as shown in FIG. 6B, the cooperation between main fold roller 87 and introduction roller 89 of envelope formation unit 85 introduces the sheet of envelope paper P2 from the envelope paper transfer path 47, then the envelope paper sensor 97 detects the timing for envelope formation unit 85 to start folding the sheet of envelope paper P2 (step 16 in FIG. 9), to thereby allow envelope formation unit 85 to fold the sheet of envelope paper P2 (step 17 in FIG. 9).

Figure 7A:
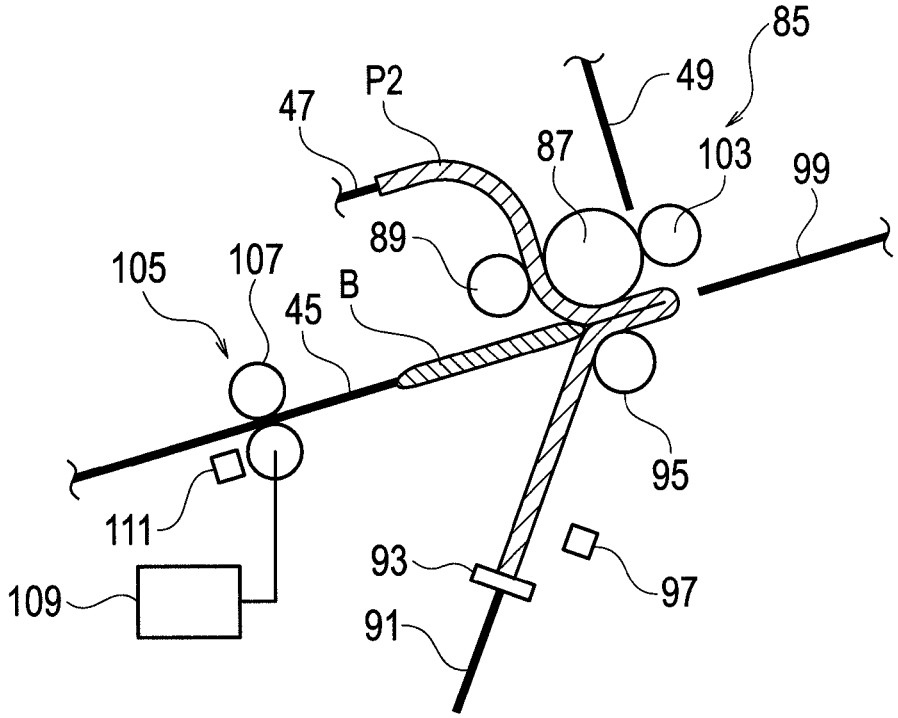
FIGS. 7A and 7B are diagrams for explaining about operations of the envelope formation unit and content delivery unit of the enclosing-sealing device, according to the embodiment of the present invention, where the content and the sheet of envelope paper are denoted schematically.
Figure 7B:
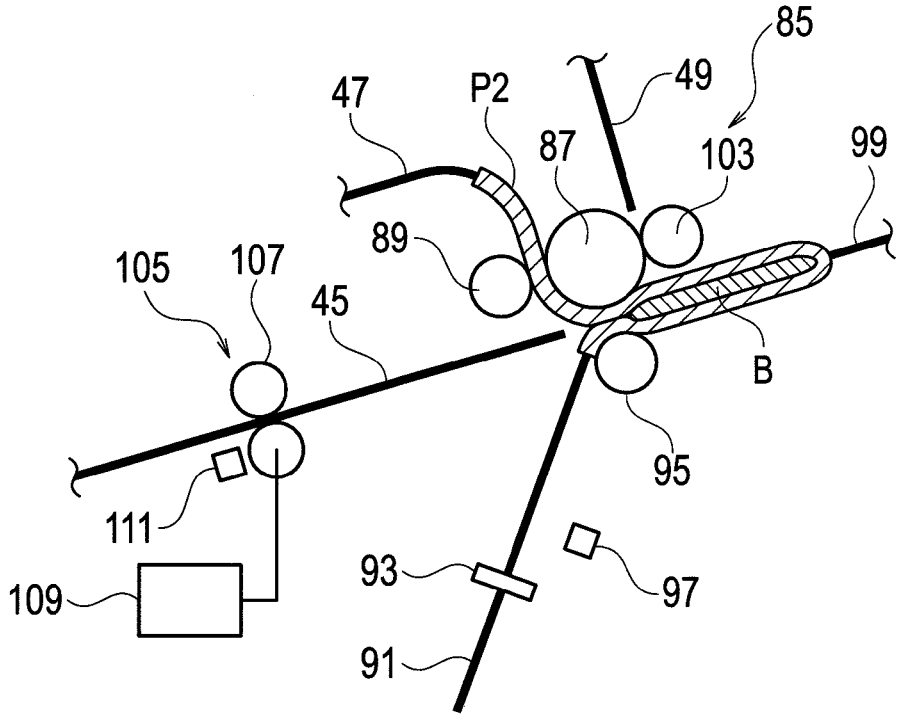

Specifically, with the area in the vicinity of fold line P2*b* of the sheet of envelope paper P2 loosened, the cooperation between main fold roller 87 and intermediate roller 95 folds the sheet of envelope paper P2 along fold line P2*b*. On the other hand, the delivery controller 127 (CPU of the enclosing-sealing controller 119) controls the delivery motor 109, thereby, as shown in FIGS. 7A and 7B, with the input of the detection signal from the envelope paper sensor 97 as a trigger, the content B is delivered to envelope formation unit 85 side in accordance with the delivery timing determined by the delivery timing determiner 125 (CPU of the enclosing-sealing controller 119) (step 18 in FIG. 9). That is, the content B is delivered to envelope formation unit 85 side after an elapse of time corresponding to the delivery timing determined by the delivery timing determiner 125 from the time point at which the delivery controller 127 received the input of the detection signal from the envelope paper sensor 97. Then, with the area in the vicinity of fold line P2*c* of the sheet of envelope paper P2 loosened, the cooperation between main fold roller 87 and lead-out roller 103 folds the sheet of envelope paper P2 along fold line P2*c*, while leading out the sheet of envelope paper P2 to the content paper transfer path 45 side. With this, from the sheet of envelope paper P2, the envelope E is formed in a state that the content B is enclosed in the envelope E, thus making it possible to deliver the envelope E to the envelope transfer path 49 side (step 19 in FIG. 9).

During the folding of the sheet of envelope paper P2, water is allowed to adhere to the watery glue which was applied in advance to the sheet of envelope paper P2.

After an end of step 19, the envelope E is transferred to the seal unit 113 side along the envelope transfer path 49. Then, a pair of seal rollers 115 of the seal unit 113 sandwich and press the envelope E to thereby seal the envelope E in a state that the content B is enclosed in the envelope E (step 20 in FIG. 9). With this, preparation of the sealed matter M ends, thereby making it possible to discharge the sealed matter M to the sealed matter discharge unit 117 by way of the envelope transfer path 49 (step 21 in FIG. 9).

After an end of step 21, when there is a next to-be-prepared sealed matter M (step 22 in FIG. 9), the routine returns to step 3 and performs processes of step 3 and thereafter.

Operations of the image formation system 1 are not limited to the above described sequential steps, for example, proper changes such as step 14 performed before step 9 or step 8 are allowed.

Thus, according to the embodiment of the present invention, the delivery timing of the content B by the content delivery unit 105 can be set to a proper delivery timing which is obtained in view of the state about the content B and envelope E, thereby making it possible to stabilize the enclosed state of the content B, sufficiently prevent the enclosing failure of the envelope E, prevent break and the like of the envelope E and suppress degradation of folding quality of the sealed matter M.

Referring to the first content correction table and the like, the correction value calculator 123 calculates the correction value of the delivery timing based on the information with respect to the content B and envelope E, and the delivery timing determiner 125 determines the delivery timing based on the correction value of the delivery timing, thus making it easy to set the delivery timing of the content B.

With the input of the detection signal from the envelope paper sensor 97 as a trigger, the delivery controller 127 controls the delivery motor 109 such that the content B is delivered to envelope formation unit 85 side in accordance with the delivery timing, thereby stabilizing the delivery of the content B by the content delivery unit 105.

The present invention is not limited to the above embodiment, and can be implemented in various embodiments. In addition, the scope of right included in the present invention is not limited to the above embodiments.

What is claimed is:

1. An enclosing-sealing device for preparing a sealed matter by sealing an envelope with a content enclosed in the envelope, the enclosing-sealing device comprising:

a content folder configured to fold a sheet of content paper to form the content;

an envelope folder configured to fold a sheet of envelope paper to form the envelope;

a content deliverer arranged downstream of the content folder, wherein the content deliverer delivers the content delivered from the content folder to the envelope folder, and wherein the content is enclosed in the sheet of envelope paper while being folded to form the envelope;

a sealer arranged downstream of the envelope folder, and configured to seal the envelope with the content enclosed in the envelope, wherein the envelope is delivered from the envelope folder;

a delivery timing determiner configured to determine an adjusted delivery timing of the content, different from a predetermined delivery timing of the content, based on an inputted information of at least one of the content and the envelope stored in an enclosing-sealing controller in the enclosing-sealing device; and a delivery controller configured to communicate with the content deliverer and to control the content deliverer to deliver the content to the envelope folder in accordance with the delivery timing determined by the delivery timing determiner, wherein the enclosing-sealing controller further comprises:

a table memory that stores at least one of a content correction table or an envelope correction table, the content correction table defining a relation between the inputted information of the content and a correction value applied to the predetermined delivery timing, the envelope correction table defining a relation between the inputted information of the envelope and the correction value applied to the predetermined delivery timing; and a correction value calculator, wherein the correction value calculator calculates the correction value applied to the predetermined delivery timing based on the inputted information of the at least one of the content and the envelope by referring to the at least one of the content correction table or the envelope correction table stored in the table memory, wherein the delivery timing determiner determines the adjusted delivery timing based on the correction value applied to the predetermined delivery timing calculated by the correction value calculator.

2. The enclosing-sealing device according to claim 1, wherein the envelope folder includes a sensor, wherein the sensor detects the sheet of envelope paper to trigger a folding of the sheet of envelope paper being fed to the envelope folder, and the delivery controller controls the content deliverer to deliver the content to the envelope folder after an elapse of time corresponding to the delivery timing timing determined by the delivery timing determiner from a time point of receiving an input of a detection signal from the sensor.

3. The enclosing-sealing device according to claim 1, wherein the content folder comprises rollers to fold the sheet of content paper to form the content.

4. The enclosing-sealing device according to claim 1, wherein the envelope folder comprises rollers to fold the sheet of envelope paper to form the envelope.

5. The enclosing-sealing device according to claim 1, further comprising:

a printer to perform printing on at least one of the sheet of content paper and the sheet of envelope paper before folding.

6. The enclosing-sealing device according to claim 1, further comprising:

a pre-fold envelope folder configured to partially fold the sheet of envelope paper before the content is enclosed in the sheet of envelope paper.

7. The enclosing-sealing device according to claim 1, wherein the delivery timing determiner is configured to determine the adjusted delivery timing of the content, different from the predetermined delivery timing of the content, based on the inputted information of the content and the envelope.

8. An image formation system comprising:

an image formation device configured to perform printing on a sheet of content paper and a sheet of envelope paper; and an enclosing-sealing device configured to prepare a sealed matter by sealing an envelope with a content enclosed in the envelope, the enclosing-sealing device being provided adjacent to the image formation device, the enclosing-sealing device including:

a content folder configured to fold a sheet of printed content paper to form the content;

an envelope folder configured to fold a sheet of printed envelope paper to form the envelope;

a content deliverer configured to deliver the content delivered from the content folder to the envelope folder, wherein the content is delivered to be disposed on the sheet of envelope paper while the sheet of envelope paper is being folded to form the envelope such that the content becomes enclosed in the formed envelope;

a sealer configured to seal the envelope delivered from the envelope folder with the content enclosed in the envelope;

a delivery timing determiner configured to determine an adjusted delivery timing of the content, different from a predetermined delivery timing of the content, based on an inputted information of at least one of the content and the envelope stored in an enclosing-sealing controller in the enclosing-sealing device; and a delivery controller configured to control the content deliverer to deliver the content to the envelope folder in accordance with the delivery timing determined by the delivery timing determiner, wherein the enclosing-sealing controller further comprises:

a table memory that stores at least one of a content correction table or an envelope correction table, the content correction table defining a relation between the inputted information of the content and a correction value applied to the predetermined delivery timing, the envelope correction table defining a relation between the inputted information of the envelope and the correction value applied to the predetermined delivery timing; and a correction value calculator, wherein the correction value calculator calculates the correction value applied to the predetermined delivery timing based on the inputted information of the at least one of the content and the envelope by referring to the at least one of the content correction table or the envelope correction table stored in the table memory, wherein the delivery timing determiner determines the adjusted delivery timing based on the correction value applied to the predetermined delivery timing calculated by the correction value calculator.

9. The image formation system according to claim 8, wherein the envelope folder includes a sensor, wherein the sensor detects the sheet of envelope paper to trigger a folding of the sheet of envelope paper being fed to the envelope folder, and the delivery controller controls the content deliverer to deliver the content to the envelope folder after an elapse of time corresponding to the delivery timing determined by the delivery timing determiner from a time point of receiving an input of a detection signal from the sensor.

10. The image formation system according to claim 8, wherein the content folder comprises rollers to fold the sheet of content paper to form the content.

11. The image formation system according to claim 8, wherein the envelope folder comprises rollers to fold the sheet of envelope paper to form the envelope.

12. The image formation system according to claim 8, wherein the delivery timing determiner is configured to determine the adjusted delivery timing of the content, different from the predetermined delivery timing of the content, based on the inputted information of the content and the envelope.

* * * * *